United States Patent [19]

Albrechtsen

[11] 4,145,589

[45] Mar. 20, 1979

[54] PUSHBUTTON ARRANGEMENT

[75] Inventor: Kaj Albrechtsen, Virum, Denmark

[73] Assignee: GNT Automatic A/S, Sølborg, Denmark

[21] Appl. No.: 810,725

[22] Filed: Jun. 28, 1977

[30] Foreign Application Priority Data

Jun. 30, 1976 [DK] Denmark ..... 2949/76

[51] Int. Cl.[2] ..... H01H 13/28

[52] U.S. Cl. ..... 200/159 R; 200/153 LA

[58] Field of Search ..... 200/159 R, 16 A, 153 LA

[56] References Cited

U.S. PATENT DOCUMENTS

| | | | |
|---|---|---|---|
| 2,951,926 | 9/1960 | Frantz et al. | 200/159 R |
| 3,193,607 | 7/1965 | Anderson | 200/159 R |
| 3,551,614 | 12/1970 | Babler | 200/159 R X |
| 3,697,706 | 10/1972 | Huggard | 200/276 X |
| 3,732,387 | 5/1973 | Berry | 200/276 X |
| 3,743,798 | 7/1973 | Pentecost | 200/159 R X |

FOREIGN PATENT DOCUMENTS

| | | | |
|---|---|---|---|
| 933949 | 5/1948 | France | 200/159 R |
| 1155505 | 6/1969 | United Kingdom | 200/159 R |

*Primary Examiner*—William Price
*Assistant Examiner*—Joseph M. Moy
*Attorney, Agent, or Firm*—Watson, Cole, Grindle & Watson

[57] ABSTRACT

A pushbutton, particularly a key of a keyboard, comprises an upper part for operation by finger touch and a lower part serving to operate an activating member, such as an electrical contact, the lower part being constructed with two surface portions of different inclination to the direction of movement of the pushbutton, said surface portions being engaged by a spring wire so as to create a sudden drop of the restoring spring force when the spring wire passes from the more inclined surface portion to the less inclined surface portion.

14 Claims, 13 Drawing Figures

PUSHBUTTON ARRANGEMENT

BACKGROUND OF THE INVENTION

The invention relates to a pushbutton arrangement comprising a pushbutton and a spring member, said pushbutton comprising an upper part operable by finger touch and a lower part engaged by said spring member and serving to operate an activating member such as an electrical contact, said spring member having a coefficient of restoring spring force decreasing upon depression of the pushbutton. A particularly important use of such an arrangement is for pushbuttons forming the keys of a keyboard.

Arrangements of the kind described are e.g. known from keyboards for electrical typewriters or calculators, where the decreasing coefficient of restoring spring force gives rise to a "break-through" effect that makes the operator feel that the operation of the key has been adequately performed. A known arrangement of this type comprises a pushbutton which is supported by a spring member in the form of a slightly domed circular thin metal plate which, when depressed by the pushbutton, on arriving at a position where the metal plate is practically plane suddenly offers less resistance to the depression and therefore moves a short distance at speed, exposing the finger of the operator to a feeble thrust while at the same time the metal plate may produce a clicking sound when passing through the said position. When the finger pressure on the pushbutton ceases, the circular plate springs back to its original position, thereby restoring the pushbutton.

SUMMARY OF THE INVENTION

According to the invention, in a pushbutton arrangement of the kind referred to, said spring member consists of at least one spring wire engaging a slanting surface of said lower part, said slanting surface comprising at least two surface portions having different angles of inclination to the direction of movement of the pushbutton, said surface portions being successively engaged by said spring wire, the surface portion engaged by the spring wire immediately before termination of the downward stroke of the pushbutton having a substantially smaller angle of inclination than the immediately preceding surface portion. A spring wire is an extremely simple and cheap spring element, which besides, owing to the wire form, may extend along the lower parts of a plurality of pushbuttons to serve them in common. Moreover, the restoring force acting on the pushbutton in its direction of movement may be accurately adjusted in accordance with the needs in each particular case simple by selection of the angles of inclination of the last and the next-to-last inclined surface portion of the lower part of the pushbutton. When the spring wire passes the transition point or line between these two surfaces, the spring force will not change, but it will suddenly act on a surface less inclined to the direction of movement of the pushbutton. Therefore its component in that direction, which constitutes the spring resistance to further depression of the key, will suddenly drop, and if the pressure on the pushbutton is continued, it will therefore "break through", i.e. move at very high speed, until the component of the spring force in the direction of movement of the pushbutton has again risen to a value corresponding to the pressure on the key. The arrangement is preferably such that before the latter stage is reached, the pushbutton has already performed its activating function. A further advantage of the arrangement according to the invention is that since the spring wire always engages the lower part of the pushbutton at a resilient pressure acting as a bias in the neutral position of the pushbutton, depression of one key of a keyboard will not cause the other keys to rattle, whereby the additional wear and the inconvenience caused by rattling is eliminated.

Preferably the arrangement is such that two spring wires engage said lower part symmetrically from opposite sides.

In accordance with one embodiment of the invention, the inclined surface portions of said lower part consist of cone-like surfaces of circular or elliptical cross-sectional shape. In this arrangement, the contact between the spring wire or wires and the inclined surface portions of the lower part of the pushbutton will be limited to a point, whereby the transition from the next-to-last to the last inclined surface portion and thereby the "break through" effect will be very distinct. Where a cone-like surface of circular cross-sectional shape is used and the angular position of the pushbutton about its axis is of no avail, the pushbutton may be rotatably mounted. The pushbutton will then be freely rotatable whereby the wear on the lower part is distributed over the whole area of the inclined surface portions. If on the other hand a definite angular position of the pushbutton is prescribed, e.g. because characters are printed on the surface of the pushbutton, the upper part of the pushbutton may have a non-circular, e.g. square cross-sectional shape and may be guided in a corresponding opening in the cover plate of the keyboard so as to prevent rotation of the pushbutton. If the cone-like surfaces have an elliptical cross-sectional shape, the engagement of the spring wire or wires with these surfaces will contribute towards maintaining the pushbutton in a definite angular position.

In accordance with another embodiment of the invention, said lower part comprises a flat cam element, one or both edges of which form said inclined surface portions. In this case the flat cam element may be used for maintaining the pushbutton in a prescribed angular position and as compared with the other embodiment mentioned above, there will be a saving of material.

In a preferred embodiment of the invention, each spring wire is rectilinear in its free state, is slidably supported in points at a distance from the zone of contact with said lower part, and is provided with end stops. This is a very simple mounting of the spring wire by which the resilient properties of the spring wire are very accurately controlled. In addition, such a spring wire may be common to a number of pushbuttons arranged in a row whereby a great simplification of the mounting of the pushbuttons constituting a keyboard is obtained.

The spring wire or each spring wire may advantageously be rotatable about its longitudinal axis whereby the wear on the spring wire will be distributed over its whole circumference and also the wear on the inclined surface portions of the pushbutton may be reduced by rolling contact between the spring wire or wires and the said surface portions.

In an alternative embodiment of the invention, each spring wire is bent to form a square having rounded corners, all four sides of said square engaging pushbuttons or, in the marginal zones of a keyboard, fixed supports. In this case where a spring wire engages four pushbuttons and one of these is depressed, the other three pushbuttons will act as supports of the spring whereby a very simple mounting of the spring wire or wires is obtained.

Advantageously, the spring wire or wires may consist of elastic, preferably stainless, material with a smooth surface and, at least in the zone of contact with the pushbutton, may have a circular or partially rounded cross-sectional shape so that wear and friction between the spring wire or wires and the lower part of the pushbutton are reduced.

Moreover, the lower part, at least in the zone of engagement of the spring wire, may be smooth and may consist of an artificial resin having a low static and dynamic coefficient of friction towards the material of the spring wires, said material being preferably selected from the group comprising polyacetals, polyamides and fluorinated polymers. On account of the wear proof properties of both the spring wire and the lower part of the pushbutton, a long lifetime of the structure is secured.

Preferably, the proportion between the inclinations, measured as the tangent of the angles of inclination to the movement of direction of the pushbutton, of the last and the next-to-last of the inclined surfaces may be in the order of 1:3. This means that at the point of transition between the next-last and the last inclined surface portion the spring resistance to depression of the key is suddenly reduced to one third (if friction is disregarded) which has been found to produce a distinct an adequate "break through" effect while maintaining a sufficient restoring force after full depression of the pushbutton.

Suitable angles of inclination are for the last inclined surface portion from 10°–40°, preferably about 30°, and for the next-last inclined surface portion from 40°–80°, preferably about 60°. It will be realized that if the preferred values of the angles are selected, the proportion between the inclinations of the two inclined surface portions will be $$\tan 30°/\tan 60° = 1:3,$$

which is the same proportion as above mentioned.

DESCRIPTION OF THE PREFERRED EMBODIMENTS

Figure 1:
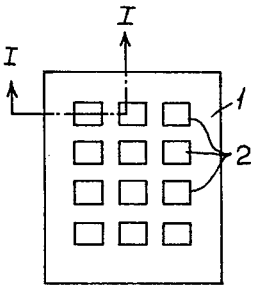
FIG. 1 shows a keyboard constructed with a plurality of pushbutton arrangements according to the invention, as viewed in vertical projection.
Figure 2:
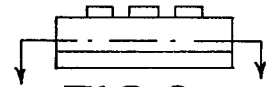
FIG. 2 is an end view of the keyboard of FIG. 1.
Figure 3:
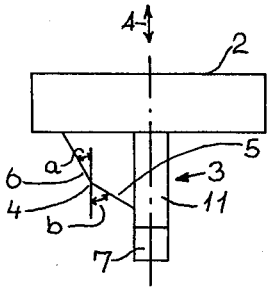
FIG. 3 is a side view on a larger scale of one form of a pushbutton according to the invention with two cam faces engaged by a single wire.
Figure 4:
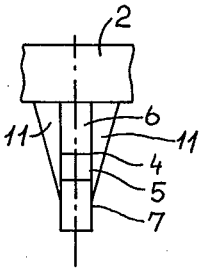
FIG. 4 shows the pushbutton of FIG. 3 as viewed from the left.

FIG. 1 shows a keyboard comprising a housing 1 provided with a plurality of pushbuttons of square configuration, the upper parts 2 of which are slidably mounted in openings of corresponding shape of the housing 1. FIG. 2 shows the keyboard in end view with the upper parts 2 of the pushbuttons protruding from the housing 1. The upper part 2 of the pushbutton shown in FIG. 3, which is intended for finger touch operation, is connected with a lower part 3 which is in the form of a cam provided at one of its side edges with two inclined surface portions 5 and 6 forming cam faces and having different inclinations to the direction of movement A of the pushbutton. The two cam faces 5 and 6 have an intersecting line 4 at which the first inclined cam face 5 has an angle of inclination b to the direction of movement A while the other cam face 6 has an angle of inclination a to the direction of movement A. At the end of the cam facing away from the upper part 2, there is provided a stud 7 which is intended for operating an activating member 16 when the pushbutton has been fully depressed. As particularly illustrated in FIG. 4, the cam is provided on its side faces with two reinforcing ribs 11.

Figure 5:
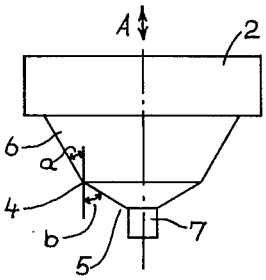
FIG. 5 shows a side view of another form of a pushbutton according to the invention, where the inclined surface portions are conical and engaged by two spring wires.
Figure 6:
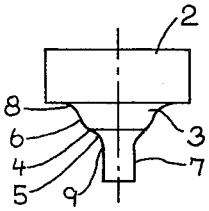
FIG. 6 is a side view of an embodiment similar to that of FIG. 5, but having rounded transitions at the ends of the surface portions remote from the line of transition.
Figure 7:
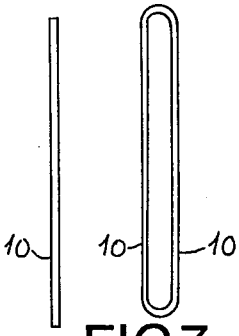
FIG. 7 shows a rectilinear spring wire and two rectilinear spring wires arranged in the form of a closed loop.

Another form of the pushbutton is shown in FIG. 5 where the inclined surface portions 5 and 6 are constituted by cone-like surfaces which likewise form the angles b and a respectively with the direction of movement A of the pushbutton. This construction is also suitable for circular pushbuttons which are not prevented from rotating about their axes, so that the wear of the inclined surface portions 5 and 6 will be uniformly distributed over the conical surfaces as will be further described in the following. In this case, the line of intersection 4 of the inclined surfaces is circular. Alternatively, the inclined surface portions 5, 6 might be constituted by cone-like surfaces of elliptical cross section in which case the line of intersection 4 will be an ellipse. FIG. 6 shows a further form of the pushbutton where the line of intersection 4 of the cone-like surfaces has been maintained, but where the ends of the said surface portions have rounded transitions 8 and 9 to the upper part 2 and the stud 7 respectively. The pushbutton arrangement according to the invention also comprises a spring member of which two examples are shown in FIG. 7, one in the form of a single rectilinear spring wire 10 and the other in the form of two rectilinear spring wires 10 connected at their ends to form a closed loop.

Figure 8:
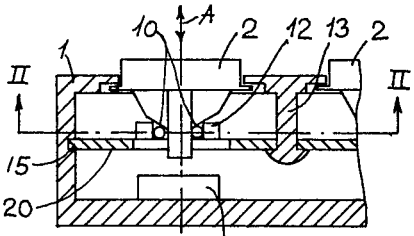
FIG. 8 is a section on a larger scale along the line I—I in FIG. 1.
Figure 9:
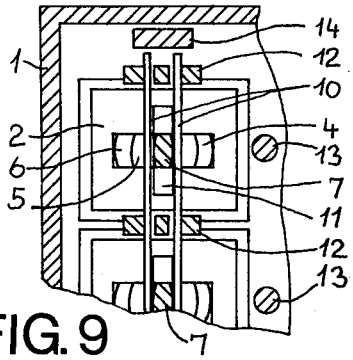
FIG. 9 is a section along the line II—II in FIG. 8, where the spring means consist of two rectilinear spring wires which are common to a plurality of pushbuttons.

FIGS. 8 and 9 show sections through the pushbutton arrangement in its neutral position. Two spring wires 10 are slidably mounted in holding members of a supporting plate 20 which is attached to the housing through grooves 15 and fastening pins 13. The supporting plate 20 is constructed with openings for the passage of the lower part 3 of the pushbutton. The spring wires 10 are prevented by end stops 14 at both ends from sliding out of the holding members 12. In the neutral position illustrated, the spring wires 10 engage the stud 7 and the first inclined surface portion 5 of the lower part 3 and are by the latter engaged with the supporting plate 20. When the pushbutton is depressed, the spring wires 10 first slide or roll along the inclined surface portion 5 and are thereby tensioned in a direction away from one another and the operator feels the increasing spring force until both spring wires 10 pass the lines of transition 4 between the inclined surface portions and thereafter slide or roll along the inclined surface portion 6, whereby, as previously explained, the resistance to movement of the pushbutton first drops and then again begins to rise, though at a lower rate than previously. During the continued movement of the pushbutton, the activating member 16 is operated. The sudden drop of the resistance to depression is distinctly sensed in the finger of the operator, who thereby obtains confirmation that the depression of the pushbutton has been sufficient to operate the activating member 16. The operator then removes the finger from the pushbutton which is then restored to the neutral position shown in FIG. 8 by the engagement of the spring wires 10 with the inclined surface portions.

The pushbutton may be made from an artificial resin material having a low coefficient of friction towards the material of the spring wire. The said artificial resin material may be selected from the group comprising polyacetals, polyamides and fluorinated polymers or similar materials having a low coefficient of friction and high wear-proofness towards the material of the spring wire which may be of a metal alloy, such as stainless steel or spring bronze. As seen in FIG. 9, a pair of spring wires serves a plurality of pushbuttons.

Figure 10:
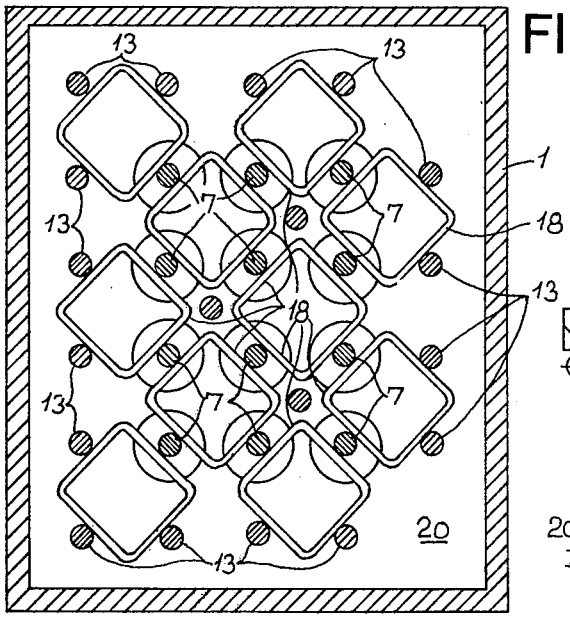
FIG. 10 is a section along the line III—III in FIG. 2 at the same level as the section II—II in FIG. 8, but where each spring element is constituted by four integrated rectilinear spring wires.

FIG. 10 shows a further embodiment where the spring element is in the form of a substantially rectangular ring 18 having rounded corners, the rectilinear portions of each spring wire being engaged either with studs 7 of the pushbuttons or with holding pins connecting the supporting plate 20 with the housing 1. Thereby the previously mentioned end stops 14 and holding member 12 are rendered superfluous, the studs 7 of the pushbuttons and the holding pins 13 of the housing taking over their function.

Figure 11:
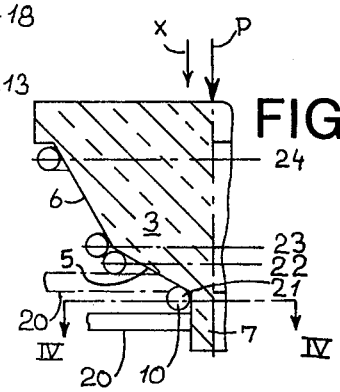
FIG. 11 is a section through a pushbutton arrangement illustrating some of the positions of a spring wire during depression of the pushbutton.
Figure 13:
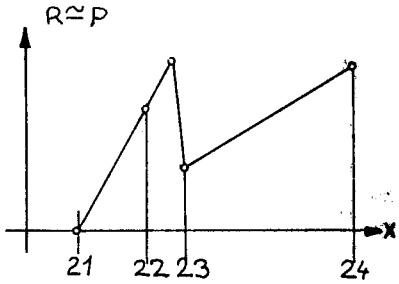
FIG. 13 is a graph illustrating the vertical restoring force of the spring wire as a function of the downward movement of the pushbutton corresponding to a selection of inclinations of the surface portions of the lower part of the pushbutton in accordance with one embodiment of the invention.
Figure 12:
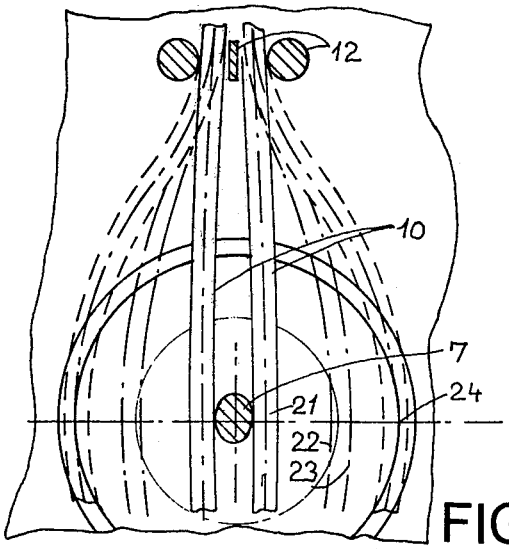
FIG. 12 is a section along the line IV—IV in FIG. 11 diagrammatically illustrating the deflection of the spring wires in the positions indicated in FIG. 11.

FIG. 11 shows the positions 21–24 of a spring wire 10 relative to the lower portion 3 of a pushbutton during the movement of the latter from its neutral position to its fully depressed position. The operator exerts a pressure P in the direction X while the spring wire constantly engages the supporting plate 20 and one of the inclined surface portions 5 and 6. FIG. 12 diagrammatically illustrates the deflection of the spring wires 10 from their neutral positions 21, which are shown in full lines, to their fully expanded positions 24, which are shown in dotted lines. Two intermediate positions 22 and 23 immediately before and after the spring wires 10 have passed the line of intersection 4 are indicated by dot-dash lines representing the axes of the spring wires. In this case, the stud 7 is shown as having an elliptical cross section, whereby the spring wires will give the pushbutton a predetermined orientation which may be expedient if the pushbutton is not otherwise secured against rotation along its longitudinal axis and if such rotation is unwanted, e.g. if characters are printed on the upper part 2 of the pushbutton. To each of the positions illustrated in FIGS. 11 and 12 corresponds a vertical restoring force R produced by the spring wires, which restoring force must be overcome by the pressure P exerted by the operator. FIG. 13 illustrates the restoring force R as a function of the depression of the pushbutton. As will be seen, the restoring force drops rather abruptly when the line of transition 4 passes by the spring wires 10, whereafter the restoring force again begins to rise, but at a lower rate than previously. The graph of FIG. 13 should be taken as qualitative only, because no account has been taken of the frictional forces and of the deflection of the spring wires 10 into the opening of the supporting plate 20 for the lower part 3.

The inclined surface portions 5 and 6 may within the scope of the invention be replaced by concave surfaces intersecting each other in at least one line of intersection. Since such a concave surface corresponds to an infinite number of successive inclined surface portions having different inclinations, it is provided, however, that at the position where the desired drop of the restoring force is to occur, the surface portions must have a line of intersection at which the surface portions form angles a and b with the direction of movement of the pushbutton suitable for creating the sudden drop of the restoring force. It has been found that a suitable proportion between the inclinations at the said line of intersection, measured as the tangent of the angles of inclinations to the movement of direction of the pushbuttons, of the last and the next-to-last of the inclined surfaces is in the order of 1:3. Suitable angles of inclination for the inclined surface portion immediately after the line of intersection 4 are from 10°–40° and for the inclined surface portion immediately before the line of intersection 4 are from 40°–80°. In a preferred embodiment, the angle a is 30° and the angle b is 60° whereby the drop of the restoring force of the spring wire at the passage of the spring wire past the line of intersection 4 during the depression of the pushbutton amounts to about 66%, which is ample to make the operator clearly sense that the pushbutton has been adequately operated.

The principle of the pushbutton arrangement according to the invention may also be applied to other mechanisms where a "break through" or momentaneous activating function is desired. Thus, this principle may be used for the operation of activating members such as pneumatic or hydraulic valves or electrical contacts where the activating function is to take place momentaneously when a control signal exceeds a certain value. In this case, the upper part of the pushbutton is replaced by a piston which can be operated by a signal pressure, a signal movement or an electrical signal through a coil. Examples of such activating members are pressostats, thermostats, hi-fi relays, and gas or air control valves.

The inclinations and locations of the inclined surface portions, the dimensions and physical properties of the spring wires and the coefficient of friction between the spring wires and the lower part of the pushbutton must be adjusted in accordance with the use for which the pushbutton arrangement is intended. For practical reasons, the coefficient of friction should preferably be below 0.15.

The spring wire may carry a short roller, the rolling surface of which is preferably concave in longitudinal section, through which roller the spring wire engages the lower part of the pushbutton. In this manner, a rolling contact is ensured which facilitates the movement of the inclined surface portions and particularly their zone of transition past the spring wire or wires. Moreover, only the coefficient of friction of the roller towards the material of the spring wire need be low while the lower part of the pushbutton may be constructed from any material. If the rolling surface of the roller has concave longitudinal section as mentioned, it will automatically be held in position on the spring wire by the engagement with the lower part of the pushbutton.

I claim:

1. A pushbutton arrangement comprising a pushbutton and a spring member, said pushbutton comprising an upper part operable by finger touch and a lower part engaged by said spring member and serving to operate an activating member such as an electrical contact, said spring member comprising at least one substantially straight spring wire engaging a downwardly and inwardly slanting surface of said lower part of said pushbutton, said slanting surface comprising at least two slanting surface portions having different angles of inclination to the direction of movement of the pushbutton, the change of angle of inclination occurring abruptly at the place of transition between the two surface portions, said surface being successively engaged by said spring wire, the surface portion last engaged by the spring wire having an angle of inclination substantially smaller than the immediately preceding surface portion, but still sufficient for initiating the restoration of the pushbutton by the engagement of the spring wire.

2. A pushbutton arrangement as in claim 1, wherein two substantially straight spring wires engage said lower part symmetrically from opposite sides.

3. A pushbutton arrangement as in claim 1 wherein inclined surface portions of said lower part consists of cone-like surfaces of circular or elliptical cross-sectional shape.

4. A pushbutton arrangement as in claim 1 wherein said lower part comprises a flat cam element, one or both edges of which form said inclined surface portions.

5. A pushbutton arrangement as in claim 1 wherein said spring wire is slidably supported in points at a distance from the zone of contact with said lower part, and is provided with end stops.

6. A pushbutton arrangement as in claim 5, wherein said spring wire is common to a number of pushbuttons arranged in a row.

7. A pushbutton arrangement as in claim 5 wherein said spring wire is rotatable about its longitudinal axis.

8. A pushbutton arrangement as in claim 1 wherein said spring wire forms one side of a square having rounded corners, all four sides of said square constituting spring wires engaging pushbuttons or, in the marginal zones of a keyboard, fixed supports.

9. A pushbutton arrangement as in claim 1 wherein said spring wire consists of elastic material with a smooth surface and, at least in the zone of contact with the pushbutton, has a rounded cross-sectional shape.

10. A pushbutton arrangement as in claim 1 wherein the lower part, at least in the zone of engagement of the spring wire, is smooth and consists of an artificial resin having a low static and dynamic coefficient of friction towards the material of the spring wires.

11. A pushbutton arrangement as in claim 1 wherein the proportion between the inclinations, measured as the tangent of the angles of inclinations to the movement of direction of the pushbutton, of the last and the next-to-last of the inclined surfaces is in the order of 1:3.

12. A pushbutton arrangement as in claim 11, wherein the angle of inclination of the last inclined surface portion is about 30° and the angle of inclination of the next-to-last inclined surface portion is about 60°.

13. A pushbutton arrangement as in claim 1 wherein said spring wire carries a short roller through which the spring wire engages the lower part of the pushbutton.

14. A pushbutton arrangement as in claim 13, wherein said short roller has a rolling surface which is concave in longitudinal section.

* * * * *